US005471828A

United States Patent [19]

King

[11] Patent Number: 5,471,828

[45] Date of Patent: Dec. 5, 1995

[54] HOT FEED DRAW TEXTURING FOR DARK DYEING POLYESTER

[75] Inventor: Charlie King, Charlotte, N.C.

[73] Assignee: Wellman, Inc., Shrewsbury, N.J.

[21] Appl. No.: 58,291

[22] Filed: May 4, 1993

[51] Int. Cl.[6] ..... D01H 13/28; D01H 13/04

[52] U.S. Cl. ..... 57/284; 57/282; 57/290; 57/351

[58] Field of Search ..... 57/282, 284, 290, 57/309, 351

[56] References Cited

U.S. PATENT DOCUMENTS

| | | | |
|---|---|---|---|
| 3,772,869 | 11/1973 | Mutschler et al. | 57/284 |
| 3,772,872 | 11/1973 | Piazza et al. | 57/140 R |
| 3,837,156 | 9/1974 | Langanke et al. | 57/157 TS |
| 3,910,027 | 10/1975 | Bach et al. | 57/290 X |
| 3,937,386 | 8/1976 | Gorrafa | 57/157 TS |
| 3,977,175 | 8/1976 | Yoshikawa et al. | 57/157 TS |
| 4,028,875 | 6/1977 | Yu et al. | 57/157 TS |
| 4,059,950 | 11/1977 | Negishi et al. | 57/140 J |
| 4,120,141 | 10/1978 | Lopatin et al. | 57/34 HS |
| 4,242,862 | 1/1981 | Negishi et al. | 57/287 |
| 4,262,481 | 4/1981 | Otaki et al. | 57/245 |
| 4,383,404 | 5/1983 | Pascoe, Sr. | 57/284 |
| 4,398,386 | 8/1983 | Endo et al. | 57/288 |
| 4,487,011 | 12/1984 | Heinrich et al. | 57/247 |
| 4,539,805 | 9/1985 | Ukai et al. | 57/290 |
| 4,567,721 | 2/1986 | Kuroda et al. | 57/284 |
| 4,648,240 | 3/1987 | Hallsworth et al. | 57/290 X |

*Primary Examiner*—Daniel P. Stodola
*Assistant Examiner*—William Stryjewski
*Attorney, Agent, or Firm*—Bell, Seltzer, Park & Gibson

[57] ABSTRACT

A method for increasing the dyeability of polyester yarn comprising heating the partially oriented yarn to a temperature between its crystallization temperature and its melting point while preventing the partially oriented yarn from shrinking, and immediately thereafter draw texturizing the partially oriented yarn to a desired draw ratio and texturization.

16 Claims, 4 Drawing Sheets

HOT FEED DRAW TEXTURING FOR DARK DYEING POLYESTER

FIELD OF THE INVENTION

The present invention relates to the manufacture and draw-texturizing of polyester fibers, and in particular relates to a method of increasing the dyeability of polyester fibers as part of the draw texturizing process.

BACKGROUND OF THE INVENTION

Polyester is a synthetic material widely used to produce filaments for a wide variety of textile applications, including fibers, yarns, and fabrics. Accordingly, one desirable property of polyester, particularly polyester fiber or yarn, is its dyeability; i.e. its ability to absorb and retain color producing dyes. The extent to which a fiber or yarn can accept dye will appropriately determine the colors or shades of colors of the resulting textile products, and thus the product's ultimate value to the consumer and the marketplace. In many circumstances, fibers or yarns that will not accept dyes, or only accept them in moderate amounts, are less valuable than those which can be dyed more successfully.

In dyeing polyester filaments or fibers, dispersed dyes are often used, and tend to be retained more successfully by the filaments when the polyester has a higher crystallinity where higher crystallinity is also accompanied by increased crystalline and amorphous volume. These regions are influenced by manufacturing conditions and thus can be controlled to a certain extent so that the degree of crystallinity will influence the physical properties of the fibers.

There are a number of methods for increasing the crystallinity of a particular fiber or filament, including polyester. Some of these are, however, rather complex or capital intensive. For example, the crystallinity of a polyester filament can be increased by increasing the winding speed at which a particular filament is formed. This is demonstrated, for example, by FIG. 1 in which differential thermal analysis is used to analyze polyester formed at different winding speeds. FIG. 1 demonstrates that the exothermic peak that characterizes the change of amorphous polyester becoming crystalline, although pronounced at winding speeds of 2,000 m/min, decreases significantly at higher winding speeds and disappears completely at about 5,500 m/min. FIG. 1 also illustrates that, at winding speeds between 2,000 and 6,000 meters per minute (m/min), the melting point of polyester (PET) remains essentially constant at about 250° C. In other words, the crystallinity of the spun polyester, and the dyeability of the resulting draw textured fiber, can be increased by increasing the winding speed during production.

An increase in winding speed, however, is not a viable option in many circumstances. For example, increasing the winding speed generally requires an entirely new or significantly enhanced spinning apparatus and a corresponding large capital expenditure. Thus, a method of increasing the crystallinity of polyester, and thus its dyeability, without such capital expenditure in increasing spinning speeds would be desirable.

In addition to dyeability, synthetic fibers such as polyester also desirably should have characteristics that mimic natural fibers in their desirable attributes; for example, breatheability, hand, thermal properties, appearance and the like. Typically, because synthetic fibers are formed as filaments, if they were combined directly into yarns, fabrics, and then garments, the resulting products would have a harsh, shiny, "plastic-looking" appearance that many consumers would find undesirable. Furthermore, their physical properties would more resemble plastic than natural textile products.

Thus, synthetic yarns such as polyester are usually treated or "textured" (or "texturized") to improve their end use characteristics. As used herein and as commonly known in this art, the terms "textured" or "texturized" describe synthetic materials manufactured as continuous filaments that are then crimped or have had random loops imparted, or that have been otherwise modified to create a different surface texture. Common texturizing techniques include air jet texturizing, stuffer box texturizing, gear crimping, edge crimping, and false twisting. In false twisting, yarn is taken from a supply and fed at a controlled draw ratio through a heating unit, and then through a false twist apparatus such as a spindle or friction surface. The twist is set into the yarn by the action of the heater and is subsequently removed at the spindle or other device resulting in a group of filaments that have a tendency to form helical springs. When woven or knitted into fabric, the cover, hand and other aesthetics of the finished fabric more closely resemble the properties of fabrics constructed from natural or other spun yarns.

In recent years, a desirable method of texturizing has been the false twist draw texturizing of partially oriented yarn (POY). In conventional processes for preparing false twisted polyester yarn, the synthetic polyester is melt spun to form a multifilament yarn which is then draw textured to provide a break elongation of about 30%. The drawing phase of the process aligns and arranges the molecular structure of the polyester molecules to obtain desired tensile properties. Simultaneously, the yarn is false twist texturized to provide the desired bulk and other texturizing properties. Typically, the texturizing step incorporates twisting the yarn, heat setting the twist in the yarn at a temperature of above 200° C., and then untwisting the yarn.

Feed yarn, however, is normally produced at a much greater rate than the rate of false twisting. For example, typical draw-texturing processes operate at speeds of 500 to 900 meters per minute, and consume POY yarns at the rate of 300 to 600 meters per minute (accounting for draw ratio). By comparison, feed yarn is produced at rates as high as 4000 m/min. In turn, the speed of feed yarn production is limited by available wind-up speeds. As a solution, the industry has combined drawing with texturizing in an effort to provide a more desirable arrangement. Accordingly, the POY technique partially orients polyester filament during melt spinning, and then both draws and texturizes the partially oriented yarn in a second subsequent step to give the final product.

Partially oriented yarn has gained widespread use in draw texturizing processes. Accordingly, because of the need to dye polyester, and because of the above mentioned capital expense and inconvenience of producing high winding speed polyester to increase the crystallinity of POY, it would be most desirable if a method existed for increasing the crystallinity of partially oriented yarn in conjunction with draw texturizing to produce a draw textured polyester yarn with increased dyeability that can be produced on conventional spinning and draw texturizing equipment without excessive revamping of such equipment.

SUMMARY OF THE INVENTION

The present invention provides a method of increasing the dyeability of partially oriented polyester yarn (POY) by heating the partially oriented yarn to just above its crystallization temperature while preventing the partially oriented yarn from shrinking, and immediately thereafter draw texturizing the partially oriented yarn to a desired draw ratio and level of texture.

The foregoing and other advantages and features of the invention, and the manner in which the same are accomplished, will become more readily apparent upon consideration of the following detailed description of the invention taken in conjunction with the accompanying drawings, which illustrate preferred and exemplary embodiments, and wherein:

DETAILED DESCRIPTION OF THE INVENTION

The present invention is a method of increasing the dyeability of yarn formed from polyester (PET) filament, particularly partially oriented polyester yarn (POY). The method comprises heating the partially oriented yarn to a temperature between its crystallization temperature and its melting point while preventing the partially oriented yarn from shrinking. Immediately thereafter the partially oriented yarn is draw texturized to a desired draw ratio, above the natural draw ratio and texturization.

As used herein, the term "partially oriented yarn" or "POY" refers to polyester filament that is produced at spinning speeds of between about 3,000 and 4,000 meters per minute (m/min). As is known to those of ordinary skill in the art, however, the term "partially oriented" is used rather broadly, and is not limited to the above speeds. Generally, filaments produced at lower spinning speeds (e.g., 2,000–2,500 m/min) are referred to as "low oriented" or "less oriented" yarns ("LOY"); those produced at higher spinning speeds (e.g., 4,000–5,000 m/min) as "highly oriented" yarns ("HOY"); and those produced at even higher speeds (5,500–6,000 m/min) as "fully oriented" yarns ("FOY"). All of these terms are typically used in a general sense, however, and are not limited to specific spinning speeds.

The advantages of the invention are applicable to all of these yarns, and thus the use of the phrase "partially oriented" is not intended to limit the scope of the invention or the claims, but rather describes—in a manner appropriate to this art—the type of yarn most commonly used, and for which the invention is particularly advantageous.

Figure 1:
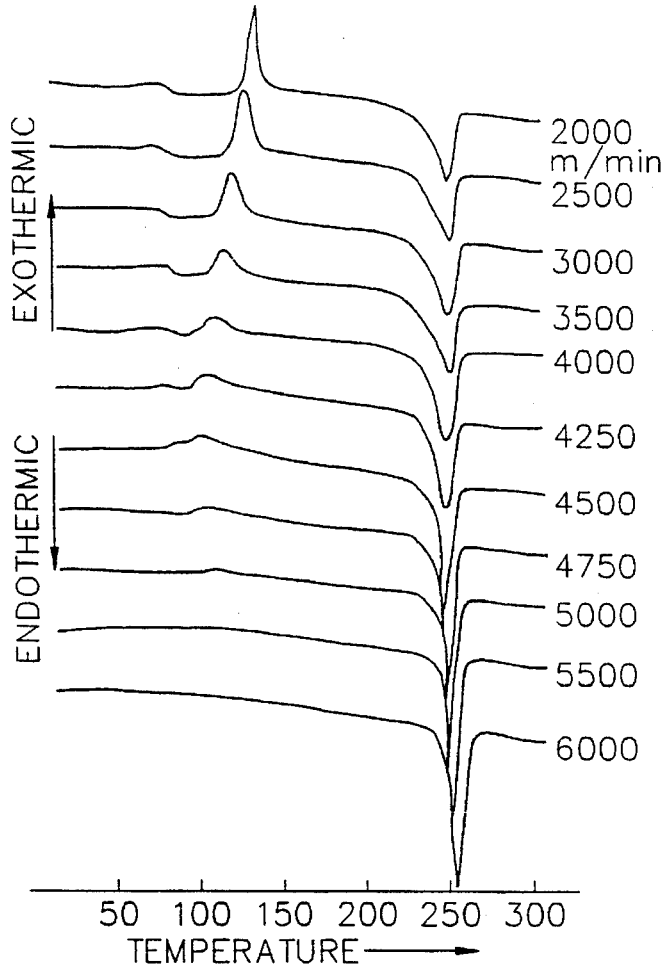
FIG. 1 is a plot of differential thermal analysis (DTA) of polyester (PET) yarns wound at the indicated velocities.

In preferred embodiments, the step of heating the partially oriented yarn to just above its crystallization temperature comprises heating the yarn to between about 100° and 125° C. depending on the windup speed (e.g., FIG. 1). In a most preferred embodiment, the step of heating the partially oriented yarn comprises heating the yarn on a heated godet; i.e. a heated roller. By heating the yarn while it passes around a godet, the yarn is prevented from shrinking so that the energy absorbed by the yarn affects its crystallization while preserving its length. As noted earlier, the advantage of the invention is the ability to provide increased crystallinity at ordinary winding speeds so that in preferred embodiments, the step of heating the yarn comprises heating yarn that has been spun wound at speeds of less than about 5,000 meters per minute (m/min; winding velocity).

Similarly, the step of heating partially oriented yarn comprises heating yarn using a draw ratio of less than about 1.50 for POY of conventional orientation and crystallinity. In this manner the T2 tension remains at the desired level so as to avoid twist surging associated with lower draw ratio and T2 tension.

As used herein, T1 refers to the tension (usually expressed in grams) between the heater and the twist stop, T2 refers to the tension just prior to the false twister, and T3 refers to the tension just after the false twister. The points are all illustrated in FIG. 2.

In preferred embodiments, the step of draw texturizing the partially oriented yarn comprises drawing the partially oriented yarn to a draw ratio of between about 1.50 and 2.00. In most preferred embodiments, the partially oriented yarn is drawn to a draw ratio of about 1.50 and 1.80.

Further to the preferred embodiments, the step of draw texturizing comprises heating the yarn to a temperature of between 150° and 225° C., provided that the texturizing temperature is above the crystallization temperature. As known to those familiar with polyester spinning and texturing, at temperatures above about 225° C., the mechanical quality of the resulting yarn tends to suffer, while temperatures below about 150° C. tend to result in insufficient bulking.

The method can further comprise the step of drawing the partially oriented polyester yarn from a supply prior to the step of heating the partially oriented yarn. Additionally, with respect to the false twist draw texturizing, the step of false twist texturizing the yarn can comprise stopping the twist at a point between the yarn supply and the point at which the partially oriented yarn is heated to above its crystallization temperature.

In an alternative embodiment, the step of false twisting comprises stopping the twist at a point between the point at which the partially oriented yarn is heated to above its crystallization temperature and the point at which the yarn is false twist texturized.

Figure 2:
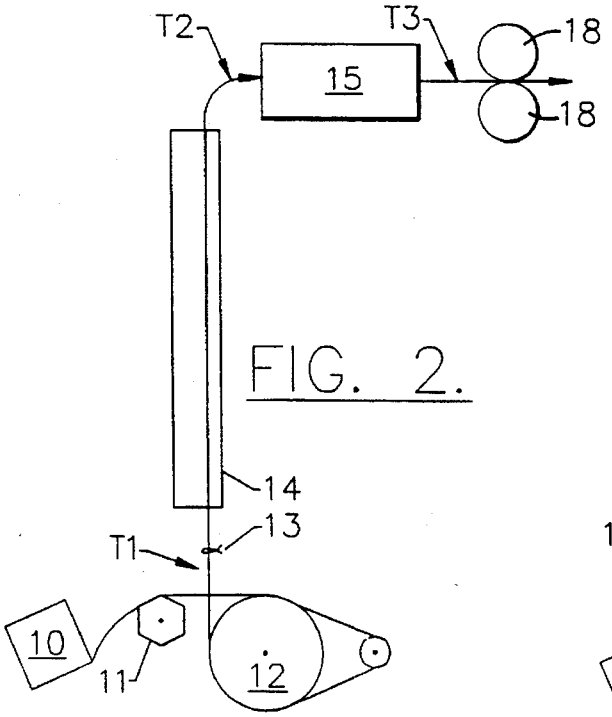
FIG. 2 is a schematic diagram of a first configuration of a draw texturizing configuration according to the present invention.
Figure 3:
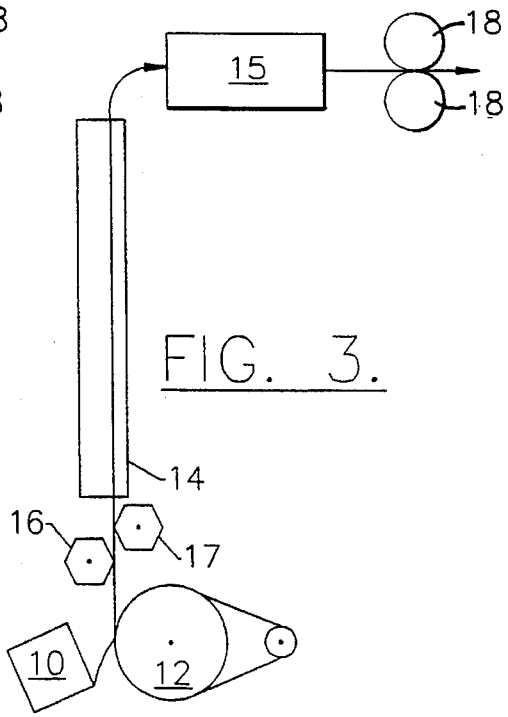
FIG. 3 is a second configuration for draw texturizing according to the present invention.

FIGS. 2 and 3 are schematic illustrations of the arrangements thus described. FIG. 2 shows a partially oriented yarn supply 10, a twist stop 11, a heated godet a pigtail guide 13, a primary heater 14, a false twisting device 15 and a mid-roll 18. As known to those familiar with false twist processes, the mid-rolls determine the speed at which textured yarn is produced. The heated godet 12 is downstream from the supply 10 of partially oriented yarn and, as noted above, heats the polyester yarn to just above its crystallization temperature. The primary false twist heater 14 is downstream of the heated godet 12 and the false twister 15 is downstream of the primary heater for adding the false twist to the polyester yarn. The twist stop 11 prevents the twist placed in the yarn by the false twister 15 from returning to the POY supply 10.

The pigtail guide 13 is positioned at an acute angle to prevent the yarn from running off the godet due to the high degree of twist torque.

Table 1 demonstrates some results using the present invention. In Table 1, the draw ratio was controlled by adjusting the speed of the godet 12 while keeping the mid-roll constant. As stated earlier, tension T2 represents the tension prior to the twisting unit, while T3 represents the tension after the twisting unit. The breaking strength and elongation were measured according to ASTM D2256 at a strain rate of 100% per minute. Hot air shrinkage, hot air crimp, and bulk were measured at 205° C. according to ASTM D4031 based on loads of 0.0004 and 0.1 grams per denier for skein measurement.

Dye update was measured using 1% blue Eastman GLF dye for 20 minutes at 260° F. Reflectance (R) of the dyed samples was measured on a Macbeth spectrophotometer. The well-known Kubelka-Munk equation was used to calculate dye concentration:

$$\frac{K}{S} = \frac{(1-R)^2}{2R}$$

where the reflectance, R, is measured at the wavelength of maximum absorbance. For convenience of comparison, the percent difference in K/S is calculated for each sample as:

$$\%\ \text{Dye} = \frac{\frac{K}{S_{sample}} - \frac{K}{S_{control}}}{\frac{K}{S_{control}}} \times 100\%$$

In this manner, it is generally accepted that the average observer can visually detect a difference of 5% dye.

The false twisting means 15 can comprise a friction false twister, a spindle false twister, or any other appropriate false twisting device known to those skilled in this art.

FIG. 3 illustrates a second configuration. For the sake of clarity, the POY supply is again illustrated at 10, the heated godet at 12, the primary heater at 14, and the false twister at 15. Configuration B, however, includes dual twist stops 16 and 17, respectively, which are stacked to arrest twist with minimal friction and disturbance of the yarn path. Because this arrangement eliminates twist torque, the yarn path can be maintained on a center line.

The results of the present invention are demonstrated by the data of Table 1 which in turn is plotted graphically in FIGS. 4 through 9. Table 1 demonstrates an evaluation of the heated godet system of the present invention on a Scragg draw texturing machine equipped with ceramic disk false twisting apparatus with a primary heater temperature of 170° C., and a throughput of 406 m/min measured at mid-roll. The secondary heater was set at off, and take-up overfeed was kept constant to achieve acceptable package formation.

TABLE 1

| Configuration | Item | Draw Ratio | Feed Roll Temp | Tensions (grams) T2 | Tensions (grams) T3 | Denier | Breaking Strength/Elongation (grams %) | | Hot Air Shrinkage/Crimping/Bulk (%/%/%) | | | % Dye |
|---|---|---|---|---|---|---|---|---|---|---|---|---|
| A | 1 | 1.60 | 25° C. | 62.7 | 54.0 | 168.2 | 623 | 26.8 | 9.4 | 10.2 | 19.6 | 24.2 |
| A | 2 | 1.70 | 25° C. | 86.8 | 80.1 | 154.2 | 581 | 17.3 | 11.8 | 11.3 | 23.1 | −4.8 |
| A | 3 | 1.80 | 25° C. | >100 | 97.5 | 148.7 | 495 | 12.4 | 11.8 | 10.2 | 22.0 | −9.5 |
| A | 4 | 1.60 | 125° C. | 82.1 | 68.8 | 168.8 | 550 | 26.2 | 12.6 | 5.7 | 18.3 | 61.3 |
| A | 5 | 1.70 | 125° C. | >100 | 86.5 | 156.6 | 552 | 20.4 | 15.0 | 13.5 | 28.5 | 30.7 |
| B | 6 | 1.60 | 125° C. | >100 | 77.3 | 166.1 | 505 | 19.4 | 15.3 | 13.5 | 28.8 | 109.4 |
| B | 7 | 1.50 | 125° C. | 70.6 | 53.8 | 179.1 | 529 | 28.0 | 17.2 | 10.9 | 28.1 | 157.4 |
| B | 8 | 1.50 | 100° C. | 66.1 | 55.9 | 178.1 | 559 | 30.6 | 13.8 | 15.9 | 29.7 | 96.0 |
| B | 9 | 1.60 | 100° C. | 98.2 | 70.8 | 160.1 | 512 | 18.1 | 12.0 | 12.6 | 24.6 | 29.3 |
| B | 10 | 1.70 | 100° C. | >100 | 79.1 | 158.0 | 529 | 17.1 | 12.7 | 11.5 | 24.2 | 17.2 |

The primary heater temperature was held at a relatively low level in an effort to maximize the signal of the feed temperature. Items 1–3 of Table 1 were produced using the configuration of FIG. 2 and at an ambient feed temperature (25° C.) to serve as a control and reflect the influence of draw ratio. Items 4 and 5 utilize the same configuration, but with the heated godet. It was noted that heating the feed roll led to an increase rather than a decrease in tensions.

The results indicate that an increase in feed temperature led to a significant increase in T2 and T3 tensions. Items 6–10 demonstrated that a change to the configuration of FIG. 3 led to an increase in T2. Although the inventors do not wish to be bound by any particular theory, this appears to result from the higher friction associated with the stacked twist stops. The T3 tensions, however, did not appear to reflect a configuration influence.

It had been expected prior to carrying out the tests of Table 1 that the heated godet would lead to a decrease in tensions. Thus, because the crystallization temperature of polyester is approximately 110° C. for standard POY, it appears that the increase in tension is probably due to crystallization. Nevertheless, this does not explain the behavior for the 100° feed temperature items (Items 8, 9 and 10) and for which the effect is unclear from the test design used. If this behavior is reproducible, it may be associated with shrinkage force.

As expected, an increase in draw ratio led to a decrease in elongation and strength. The feed temperature had little influence on elongation, but a change in configuration did. The overall strength was reduced as a result of increased feed temperature and configuration.

The lack of improvement in strength was somewhat expected because the tensions increased rather than decreased as a result of feed temperature and configuration. Apparently, the yarn continued to draw in the primary heater. Thus, further improvements are expected if feed temperature can be increased in the presence of a suitable configuration in which the yarn draws on the feed roll without twist (a disorienting influence) while minimizing friction (abrasion).

It did appear that an increase in crimp was possible as a result of early twist stoppage and heated feed. The control items (1–3) averaged about 11% crimp with no influence of draw ratio as expected.

The dye depth responded to both feed temperature and configuration, with the expected influence of draw ratio. As indicated in Table 1 and FIG. 7, the proper combination of variables can lead to an increase of about 150% in dye depth while maintaining comparable tensions and elongation, but while sacrificing breaking strength. Item 7 is a possible example of the net effect desired being obtained from a lower draw ratio and a higher feed temperature.

This degree of increased dye depth has not been achieved by any other means when the draw texturing or spinning conditions have been altered while maintaining constant texturing tensions and yarn elongations. As noted in the background, higher orientation POY produced by higher speed spinning which is textured to the same tension gives darker dyeing as a result of higher crystallinity but the magnitude of such increase is less than that observed using the present invention.

Overall, increasing the feed temperature gave an unexpected increase in texturizing tensions and a major increase in dye uptake. Although the inventor does not wish to be bound by any particular theory, this is probably due to crystallization of the POY prior to entering the draw zone. Other means for obtaining the same effect could include introducing a hot plate or tube between the POY supply and the standard input roll, provided that some means was included for keeping the length constant, or at least controlled, rather than free to shrink with temperature.

Figure 4:
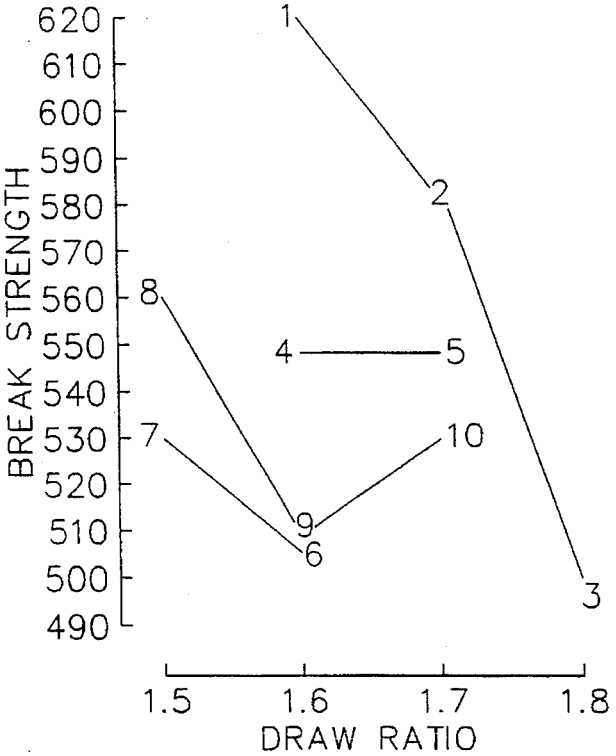
FIG. 4 is a plot of breaking strength versus draw ratio and comparing yarns produced conventionally and according to the present invention.
Figure 5:
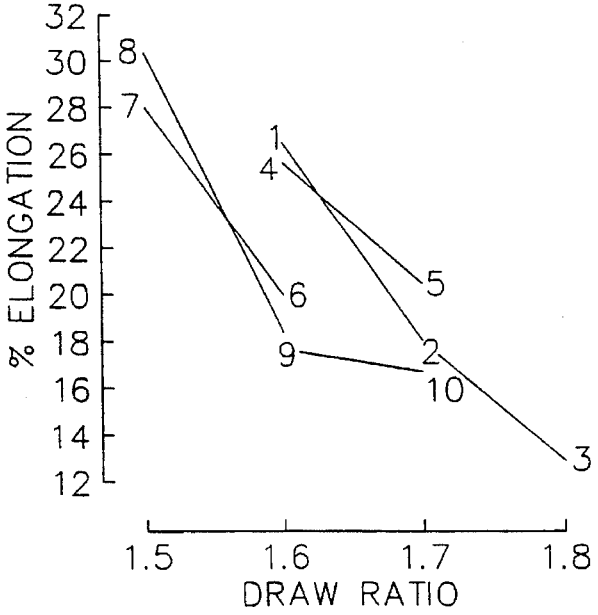
FIG. 5 is a similar plot but showing elongation plotted against draw ratio.

FIG. 4 is a graphical representation of the change in break strength of yarns produced according to the present invention, while FIG. 5 shows the change in percent elongation.

Figure 6:
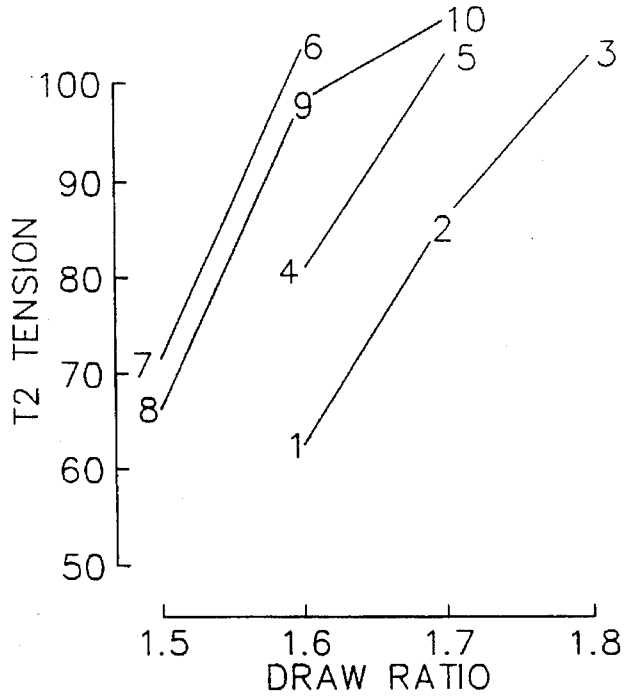
FIG. 6 is another similar plot showing T2 tension taken against draw ratio.
Figure 9:
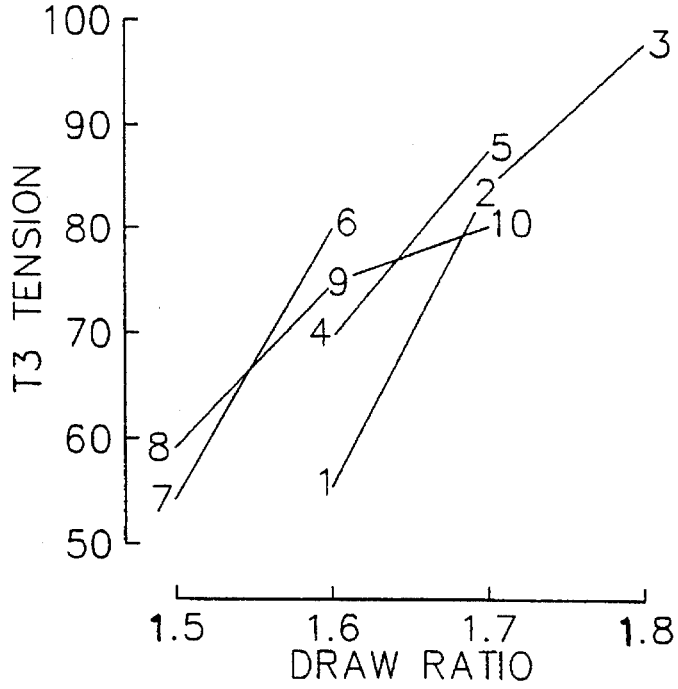
FIG. 9 illustrates T3 tension taken against draw ratio.

FIGS. 6 and 9 show the changes in T2 and T3 tensions with the greatest changes being noted in Configuration B (FIG. 3) at a temperature of 125° C.

Figure 7:
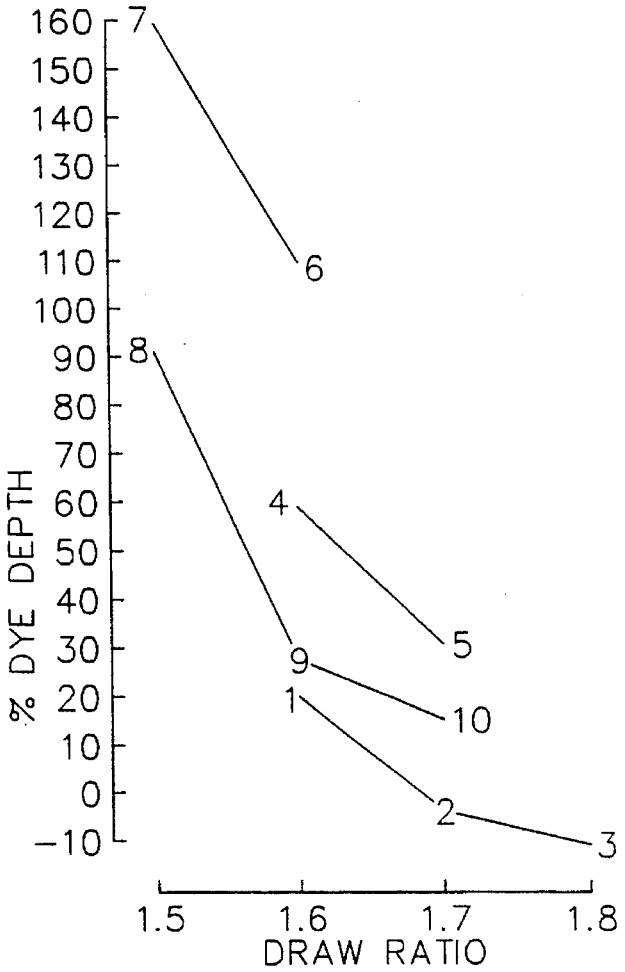
FIG. 7 shows percentage dye strength taken against draw ratio.

FIG. 7 shows the large increase in dye depth of each of the heated samples with the greatest increase again being noted using Configuration B at a temperature of 125° C.

Figure 8:
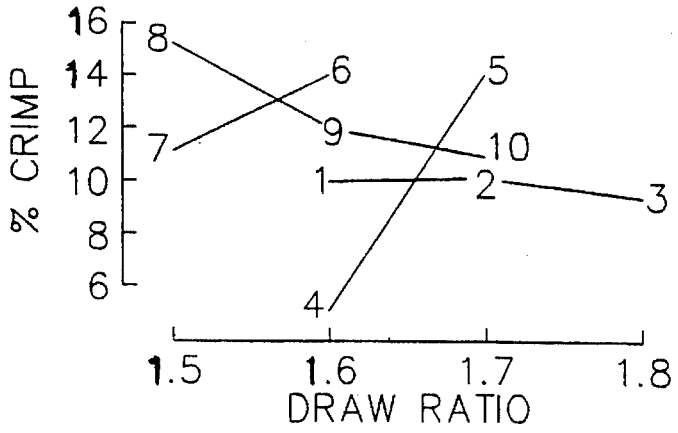
FIG. 8 shows percentage crimp taken against draw ratio.

Finally, FIG. 8 illustrates percentage crimp of the various samples set forth in Table 1.

In the drawings and specification, there have been disclosed typical preferred embodiments of the invention and, although specific terms have been employed, they have been used in a generic and descriptive sense only and not for purposes of limitation, the scope of the invention being set forth in the following claims.

That which is claimed is:

1. A method of increasing the dyeability of polyester yarn, the method comprising:

heating the yarn to a temperature between its crystallization temperature and its melting point while preventing the yarn from shrinking; and immediately thereafter draw texturizing the heated yarn at a draw ratio above the natural draw ratio.

2. A method according to claim 1 wherein the steps of heating and draw texturizing the yarn comprises heating and draw texturizing partially oriented yarn.

3. A method according to claim 2 wherein the step of heating the partially oriented yarn to a temperature between its crystallization temperature and its melting point comprises heating the yarn to greater than 100° C.

4. A method according to claim 2 wherein the step of heating the partially oriented yarn comprises heating partially oriented yarn that has been produced at a speed of less than about 6000 meters per minute.

5. A method according to claim 2 wherein the step of heating the partially oriented yarn comprises heating partially oriented yarn that has been produced at a speed of between 3000 and 4000 meters per minute.

6. A method according to claim 2 wherein the step of draw texturizing the partially oriented yarn comprises drawing the partially oriented yarn to a draw ratio of between 1.50 and 2.00.

7. A method according to claim 2 wherein the step of draw texturizing the partially oriented yarn comprises heating the yarn to a temperature of between 150° and 225° C.

8. A method according to claim 1 wherein the step of heating the yarn comprises heating the yarn on a heated godet.

9. A method according to claim 1 wherein the step of preventing the yarn from shrinking comprises heating the yarn while it passes around a godet.

10. A method of thermally inducing increased crystallinity in polyester yarn and resultingly increasing the dyeability of the polyester yarn, the method comprising: drawing a partially oriented polyester yarn from a supply;

heating the partially oriented yarn to a temperature between its crystallization temperature and its melting point while preventing the partially oriented yarn from shrinking; and immediately thereafter false twist draw-texturizing the heated partially oriented yarn at a draw ratio above the natural draw ratio.

11. A method according to claim 10 wherein the step of false twist draw texturizing the yarn comprises stopping the false twist at a point between the yarn supply and the point at which the partially oriented yarn is heated to above its crystallization temperature.

12. A method according to claim 11 wherein the step of false twist draw-texturizing the heated partially oriented yarn comprises drawing the partially oriented yarn at a draw ratio of 1.50.

13. A method according to claim 11 wherein the step of false twist draw-texturizing the heated partially oriented yarn comprises drawing the partially oriented yarn at a draw ratio of 1.60.

14. A method according to claim 11 wherein the step of false twist draw-texturizing the heated partially oriented yarn comprises drawing the partially oriented yarn at a draw ratio of 1.70.

15. A method according to claim 11 wherein the step of false twist draw-texturizing the heated partially oriented yarn comprises drawing the partially oriented yarn at a draw ratio of 1.80.

16. A method according to claim 10 wherein the step of false twist draw texturizing the yarn comprises stopping the false twist at a point between the point at which the partially oriented yarn is heated to above its crystallization temperature and the point at which the yarn is false twist texturized.

* * * * *

UNITED STATES PATENT AND TRADEMARK OFFICE

CERTIFICATE OF CORRECTION

PATENT NO. : 5,471,828

DATED : December 5, 1995

INVENTOR(S) : King

It is certified that error appears in the above-identified patent and that said Letters Patent is hereby corrected as shown below:

Title page, item

[56] References Cited: U.S. Patent No. "3,937,386" should be --3,973,386--.

Column 4, line 58, after "godet" insert --12,--.

Columns 5-6 (Table 1), line 3 of heading, "(grams %)" should be --(grams/%)--.

Column 7, line 6, "150%" should be --150%--.

Signed and Sealed this

Seventh Day of May, 1996

Bruce Lehman

*Attest:*

BRUCE LEHMAN

*Attesting Officer*

*Commissioner of Patents and Trademarks*